US006648468B2

(12) United States Patent
Shinkoda et al.

(10) Patent No.: US 6,648,468 B2
(45) Date of Patent: Nov. 18, 2003

(54) SELF-REGISTERING FLUID DROPLET TRANSFER METHODS

(75) Inventors: Ichiro Shinkoda, Vancouver (CA); Daniel Gelbart, Vancouver (CA)

(73) Assignee: Creo Srl, Burnaby (CA)

( * ) Notice: Subject to any disclaimer, the term of this patent is extended or adjusted under 35 U.S.C. 154(b) by 0 days.

(21) Appl. No.: 10/211,516

(22) Filed: Aug. 5, 2002

(65) Prior Publication Data

US 2003/0038871 A1 Feb. 27, 2003

Related U.S. Application Data

(63) Continuation-in-part of application No. 09/631,710, filed on Aug. 3, 2000, now Pat. No. 6,443,571.

(51) Int. Cl.[7] ..... B41J 2/01
(52) U.S. Cl. ..... 347/103
(58) Field of Search ..... 347/103, 55, 151, 347/120, 20, 141, 154, 123, 111, 159, 127, 128, 131, 125, 158, 40, 12; 399/271, 290, 292, 293, 294, 295

(56) References Cited

U.S. PATENT DOCUMENTS 4,272,771 A * 6/1981 Furukawa
4,293,866 A * 10/1981 Takita
4,525,721 A * 6/1985 Crean
4,538,156 A * 8/1985 Durkee
4,673,303 A * 6/1987 Sansone
4,809,016 A * 2/1989 Padalino
5,070,345 A * 12/1991 Lahut
5,099,256 A * 3/1992 Anderson
5,124,720 A * 6/1992 Schantz
5,398,053 A * 3/1995 Hirosawa
5,796,418 A * 8/1998 Silverbrook

* cited by examiner

*Primary Examiner*—Raquel Yvette Gordon
(74) *Attorney, Agent, or Firm*—Oyen Wiggs Green & Mutala

(57) ABSTRACT

A method for the image-wise transfer of fluid droplets from at least one fluid droplet source onto a substrate comprises ejecting fluid droplets from the at least one fluid droplet source onto a transfer surface. The fluid droplets may be water-based or oil based. The transfer surface repels the fluid droplets. For water-based fluid droplets, the transfer surface comprises a spatially periodic arrangement of less-strongly hydrophobic regions and more-strongly hydrophobic regions. The method includes adjusting a spatial registration of the fluid droplets on the transfer surface; and transferring the fluid droplets from the transfer surface to the substrate by bringing the fluid droplets on the transfer surface into contact with the substrate.

47 Claims, 6 Drawing Sheets

SELF-REGISTERING FLUID DROPLET TRANSFER METHODS

CROSS-REFERENCE TO RELATED APPLICATION

This application is a continuation in part of application Ser. No. 09/631,710 filed Aug. 3, 2000 now U.S. Pat. No. 6,443,571.

TECHNICAL FIELD

The invention pertains to the general field of printing and in particular to inkjet printing.

BACKGROUND

While there is a considerable variation in the products on offer and the specific technology employed, inkjet printing typically involves expelling small droplets of ink-bearing liquid from miniature nozzles onto the surface of a substrate. Each droplet represents a pixel to be printed. An array of such nozzles is then scanned across (i.e. moved relative to) the substrate in order to address each pixel position. An electronic control unit controls the scanning process and, depending on the image data, sends instructions to individual nozzles as to whether they should print at a given position or time. Because the electronic control unit directs nozzles to expel ink droplets or to refrain from expelling ink droplets based on image data, the ink droplets are said to be "image-wise" expelled onto the substrate. Some color printers use inkjet technology.

FIG. 1 depicts a prior art inkjet head 10 printing on a substrate 12. Inkjet head 10 comprises an array 16 of inkjet nozzles 14. For the sake of clarity, inkjet head 10 is depicted in FIG. 1 as comprising a single one-dimensional array 16 of nozzles 14. The image-wise expulsion of ink from each individual nozzle 14 is controlled by a controller (not shown). The controller moves inkjet head 10 in a scan direction 18 relative to substrate 12 and, using image data, directs individual nozzles 14 to eject fluid ink droplets 20. Repeated emission of fluid ink droplets 20 creates tracks or channels 22 of image-wise printed dots 24 on the surface of substrate 12. Ideally, as exemplified by nozzle 14A, fluid ink droplets 20A are ejected substantially straight from the tips of nozzle 14 to form substantially straight channels 22 on substrate 12.

A problem with inkjet printing is illustrated by nozzle 14E. As shown in FIG. 1, the fluid ink droplets 20E emitted by nozzle 14E exhibit inconsistent trajectories resulting in image-wise printed dots 24E that are not properly aligned in their channel 22E. Inconsistent or off-center expulsion of fluid ink droplets 20 by nozzles 14 may result in printed images that exhibit banding or striations. Inconsistent or off-center expulsion may be may be caused, inter alia, by partially failed or clogged nozzles 14, by aerodynamic forces that change the paths of fluid ink droplets 20, and by "cross-talk effects" between adjacent or closely proximate nozzles 14.

In effort to reduce the inconsistency of fluid droplet emission trajectories, U.S. Pat. No. 4,054,882 (Ruscitto), U.S. Pat. No. 4,219,822 (Paranjpe) and U.S. Pat. No. 4,525,721 (Crean) disclose the use of electrostatic fields to guide fluid ink droplets after they have been emitted from inkjet nozzles.

PCT Application No. PCT/IL96/00150 and U.S. Pat. No. 6,354,701 (the "Korem Patents") disclose apparatus for ink jet printing involving a printing member patterned with an ink receptive portion having a number of ink receptive dots in a desired resolution and an ink repelling portion that includes the remaining area of the printing member. Fluid ink droplets are image-wise expelled from nozzles onto the ink receptive dots and then transferred from the printing member to a printing substrate.

Intermediate transfer surfaces, such as the printing member of the Korem Patents, have a tendency to retain ink, thereby decreasing ink utilization efficiency, reducing the amount of ink transferred to the substrate and making the intermediate transfer surfaces difficult to clean.

There is a need for inkjet printing apparatus and methods that ameliorate at least some of the disadvantages mentioned above.

SUMMARY OF THE INVENTION

In accordance with the present invention, a method for the image-wise transfer of fluid droplets from at least one fluid droplet source onto a substrate is disclosed. The fluid droplets may be water-based or oil-based. If the fluid droplets are water-based, the method comprises ejecting the fluid droplets from fluid droplet source onto a hydrophobic transfer surface which comprises a spatially periodic plurality hydrophobic regions that are less hydrophobic than a remainder of the transfer surface. If the fluid droplets are oil-based, the method comprises ejecting the fluid droplets from fluid droplet source onto a oleophobic transfer surface which comprises a spatially periodic plurality oleophobic regions that are less oleophobic than a remainder of the transfer surface. The method also comprises transferring the fluid droplets from the transfer surface to the substrate by bringing the fluid droplets on the transfer surface into contact with the substrate.

The method may also involve adjusting a spatial registration of the fluid droplets on the transfer surface, wherein adjusting the spatial registration of the fluid droplets on the transfer surface may comprise permitting the fluid droplets to interact with the hydrophobic (oleophobic) transfer surface and at least one of the plurality of less hydrophobic (oleophobic) regions.

The fluid droplet source may comprise a plurality of fluid droplet sources spaced apart from one another by a separation and there may be an integer relationship between a period of the less hydrophobic (oleophobic) regions and the separation of the fluid droplet sources.

The method may involve modifying one or more rheological characteristics of the fluid droplets while the fluid droplets are on the transfer surface. Such modifications may involve: curing the fluid droplets, partially curing the fluid droplets, increasing a viscosity of the fluid droplets, changing a solubility of the fluid droplets, changing a surface energy of the fluid droplets and/or evaporating a solvent contained in the fluid droplets. Such modifications may be accomplished by: irradiating the fluid droplets with electromagnetic energy; subjecting the fluid droplets to vacuum treatment, subjecting the fluid droplets to gaseous flow treatment, subjecting the fluid droplets to chemical treatment and heating the fluid droplets.

The method may comprise modifying sizes of the fluid droplets while the fluid droplets are on the transfer surface.

The fluid droplet source may comprise an ink jet printer head. The transfer surface may be disposed on a cylindrical surface of a drum roller or, alternatively, may be the surface of a drum roller. Bringing the fluid droplets on the transfer surface into contact with the substrate may comprise rolling the substrate against the drum roller.

The transfer surface may comprise a belt member and the method may involve circulating the belt member while ejecting fluid droplets onto the transfer surface.

The less hydrophobic (oleophobic) regions may be periodic in one dimension. They may also be periodic in two dimensions. The less hydrophobic (oleophobic) regions may comprise depressions in the hydrophobic (oleophobic) transfer surface.

Ejecting fluid droplets from the one or more fluid sources onto a hydrophobic (olephobic) transfer surface may comprise making multiple passes between the inkjet head and the transfer surface and, in each such pass, depositing a plurality of fluid droplets onto the transfer surface. The plurality of fluid droplets deposited on each pass may comprise fluid droplets of a different color. The pluralities of fluid droplets deposited during successive passes may be spatially interleaved with one another.

Transferring the fluid droplets from the transfer surface to the substrate may comprise making multiple passes between the transfer surface and the substrate and, in each such pass, transferring a plurality of fluid droplets onto the substrate. The plurality of fluid droplets transferred on each pass may comprise fluid droplets of a different color. The pluralities of fluid droplets deposited during successive passes may be spatially interleaved with one another.

The method may comprise curing the fluid droplets on the substrate, which may involve: irradiating the fluid droplets with electromagnetic energy; subjecting the fluid droplets to vacuum treatment, subjecting the fluid droplets to gaseous flow treatment, subjecting the fluid droplets to chemical treatment and heating the fluid droplets.

Ejecting the fluid droplets from the at least one fluid droplet source onto a hydrophobic transfer surface may comprise ejecting fluid droplets of different colors onto the hydrophobic (olephobic) transfer surface. Transferring the fluid droplets from the transfer surface to the substrate may comprise simultaneously transferring fluid droplets of different colors.

Further aspects of the invention and features of specific embodiments of the invention are described below.

BRIEF DESCRIPTION OF THE DRAWINGS

In drawings which depict non-limiting embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

In accordance with the present invention, fluid ink droplets are image-wise transferred from a fluid droplet source to a patterned transfer surface. The fluid ink droplets may be colored. The fluid droplet source is preferably, although not necessarily, an inkjet head having a plurality of nozzles that expel fluid ink droplets onto the patterned transfer surface. Fluid ink droplets may be expelled from the inkjet head onto the transfer surface in a single pass or in multiple passes. Each pass between the inkjet head and the transfer surface may be interleaved with preceding passes to obtain higher resolution images. Additionally or alternatively, each such pass may comprise expulsion of a single color of ink droplets or a plurality of different colored ink droplets.

The patterned transfer surface comprises a periodic plurality of low energy regions. Fluid ink droplets deposited onto the transfer surface register themselves to the low energy regions. The precisely positioned colored ink droplets are then transferred to the substrate in a single pass or in multiple passes. In general, the transfer surface may be of any shape or design suitable to transfer the fluid ink droplets to the substrate. If the fluid droplets are water-based, then the patterned transfer surface is hydrophobic to maximize transfer efficiency, minimize wasted ink and minimize the difficulties associated with cleaning leftover ink from the transfer surface and spreading of leftover ink into other system components. For the same reasons, if the ink droplets are oil-based, then the patterned transfer surface is oleophobic.

Certain characteristics of the fluid ink droplets, such as their size and/or other rheological properties, may be altered in post-expulsion treatments that take place while the droplets are on the transfer surface. Once transferred to the substrate, the ink droplets may be cured by any of a number of processes.

The word "ink" and phrases "ink droplet(s)" and "fluid droplet(s)" are used as a matter of convenience throughout this description. The invention may generally employ any fluid capable of being ejected from an inkjet nozzle, such as: ink, resin, photo-resist and thermal resist, for example. Accordingly, the work "ink" and the phrases "ink droplet(s)" and "fluid ink droplet(s)" should be interpreted in a broad sense, to include any suitable fluid capable of being ejected from an inkjet nozzle. Colored ink used in this invention may be of any suitable type including a pigment type ink and/or a dye type ink.

Figure 1:
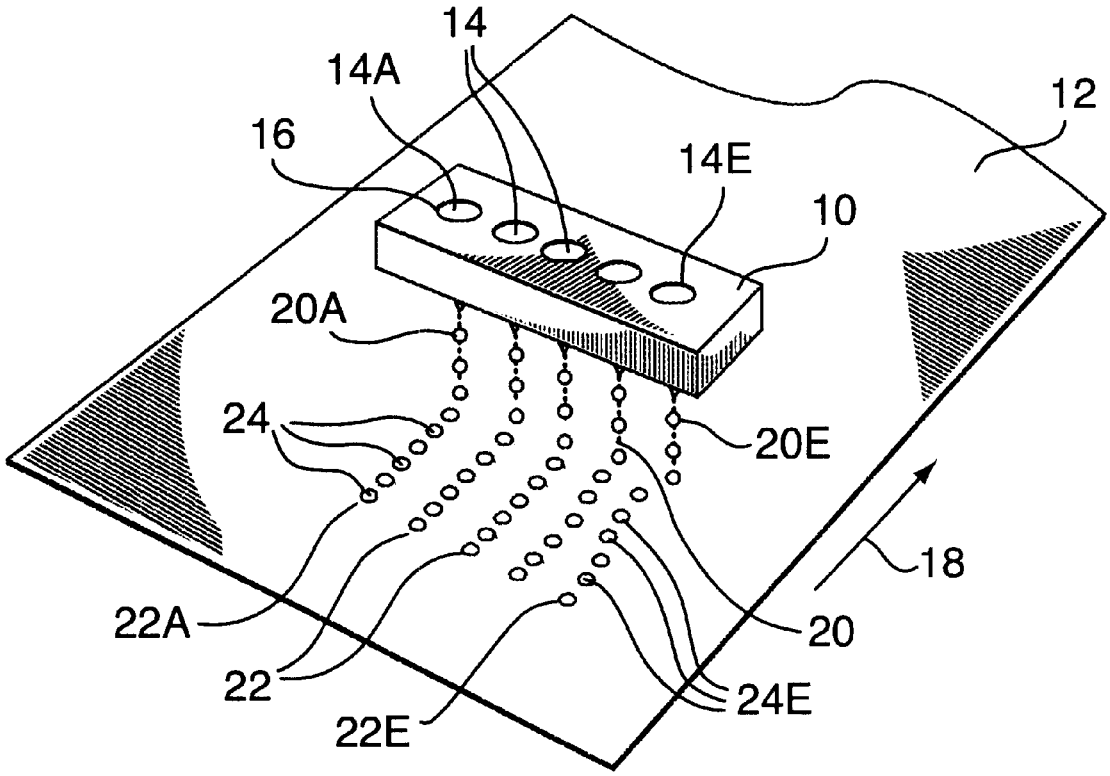
FIG. 1 PRIOR ART
FIG. 1 depicts a prior art inkjet head having a nozzle that expels fluid ink at inconsistent trajectories.
Figure 2:
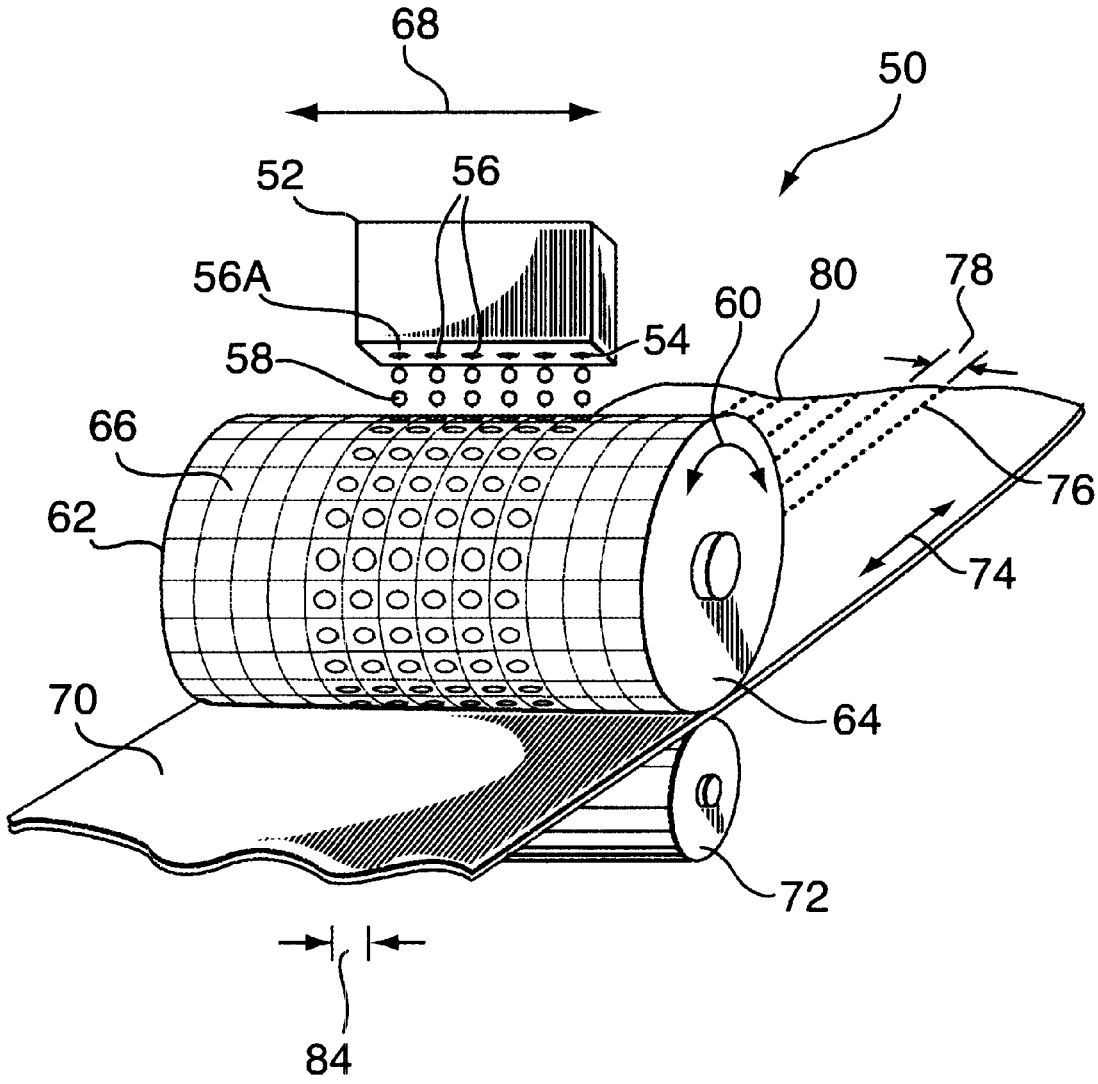
FIG. 2 is an isometric view of a method and apparatus for inkjet printing on a substrate according to one embodiment of the invention.

FIG. 2 depicts a printing apparatus 50 according to a particular embodiment of the invention. For the sake of clarity, inkjet head 52 is shown in the illustrated embodiment to comprise a one-dimensional array 54 of nozzles 56. Nozzles 56 are individually addressable by a controller (not shown), which uses image data to direct individual nozzles 56 to expel fluid ink droplets 58 at desired locations onto transfer surface 62. In the illustrated embodiment, transfer surface 62 is disposed on the cylindrical surface of a drum 64. In some embodiments, transfer surface 62 may be the cylindrical surface of drum 64. Transfer surface 62 comprises a plurality of cells 66, which have properties (described further below) that cause ink droplets 58 to position (i.e. register) themselves within cells 66. The cells are preferably arranged periodically. In the illustrated embodiment, the spatial period of cells 66 is the same as the spatial period of nozzles 56 in array 54.

Drum 64 rotates in either or both of the directions indicated by double-headed arrow 60. In addition to controlling the expulsion of ink droplets 58 from individual nozzles 56, the controller may also control the relative movement of inkjet head 52 and drum 64 to coordinate the image-wise expulsion of ink droplets 58 with the rotation of drum 64. In the illustrated embodiment, inkjet head 52 is smaller in width than transfer surface 62. To cover the entire area of transfer surface 62, the controller may cause inkjet head 52 to be "stepped" across drum 64 (in either or both of the lateral directions indicated by double-headed arrow 68) and may cause multiple passes between inkjet head 52 and drum 64 (in either or both of the directions of double-headed arrow 60). In this manner, if desired, a fluid ink droplet 58 may be image-wise expelled into any or each of cells 66. In other embodiments (not shown), inkjet head 52 may be made sufficiently wide to cover the entire width of transfer surface 62. In such embodiments, only a single pass between inkjet head 52 and transfer surface 62 may be required.

Multiple passes of ink jet head 52 may also be used where each pass of inkjet head 52 applies a different color of fluid ink droplets 58. For example, red ink droplets 58 may be applied to transfer surface 62 in a first pass, blue ink droplets 58 may be applied to transfer surface 62 in a second pass and green ink droplets 58 may be applied to transfer surface 62 in a third pass. As an additional or alternative example, printing apparatus 50 may use a CMYK process, where cyan ink droplets 58 may be applied to transfer surface 62 in a first pass, magenta ink droplets 58 may be applied to transfer surface 62 in a second pass, yellow ink droplets 58 may be applied to transfer surface 62 in a third pass and black ink droplets 58 may be applied to transfer surface 62 in a fourth pass. Multiple colors of ink droplets 58 may also be applied from nozzles 56 to transfer surface 62 in a single pass.

Figure 3A:
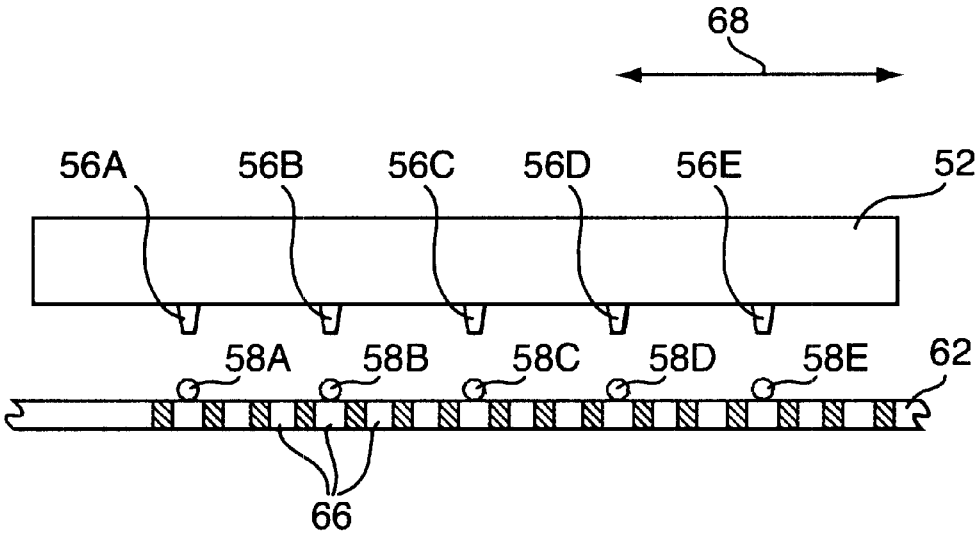
FIGS. 3A to 3C depict a particular embodiment of a method for interleaving between the inkjet head and the transfer surface according to the invention.
Figure 3B:
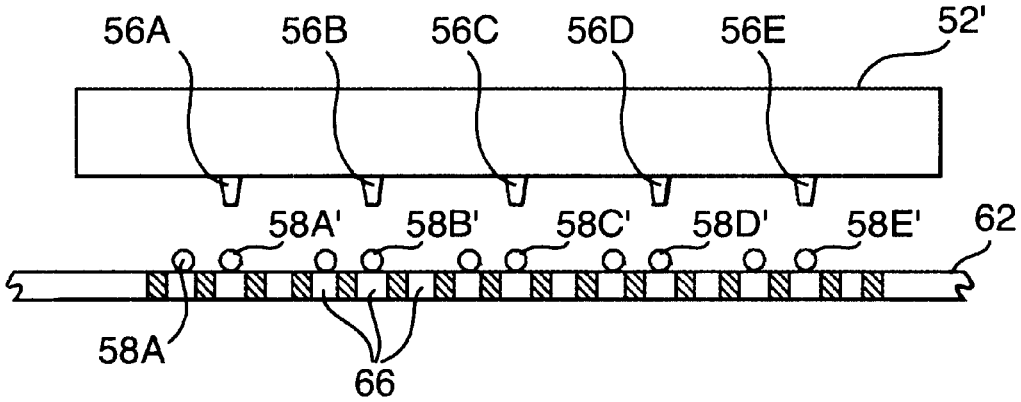
Figure 3C:
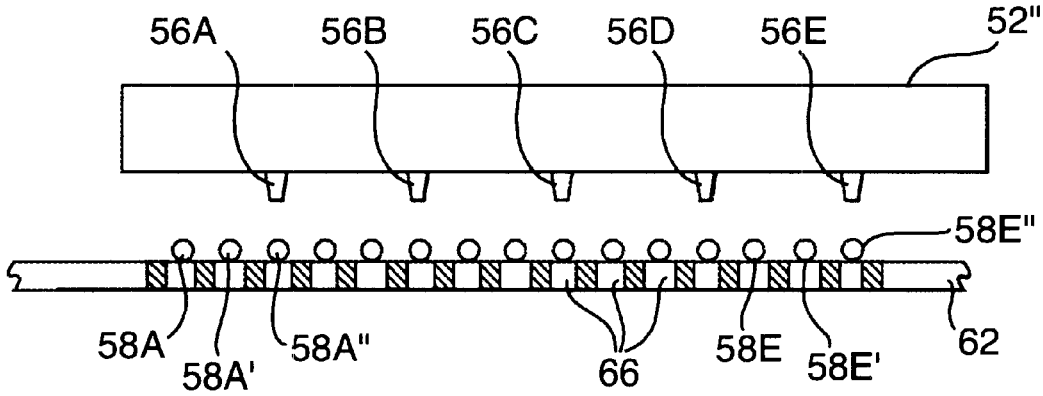

Alternatively or additionally, where the spatial period 84 of cells 66 on transfer surface 62 is less than the lateral spacing of nozzles 56 in inkjet head 52, multiple passes between inkjet head 52 and transfer surface 62 may be used to effect an interleaved deposition of fluid ink droplets 58 onto transfer surface 62. A particular example of interleaved deposition of fluid ink droplets 58 onto transfer surface 62 is shown in FIGS. 3A to 3C. FIGS. 3A to 3C are sectional views of an inkjet head 52 expelling ink droplets 58 from its nozzles 56 onto transfer surface 62 having a periodic pattern of cells 66. FIG. 3A depicts a first pass, wherein inkjet head 52 is in first position and each nozzle 56 of inkjet head 52 expels fluid ink droplets 58, which register themselves in cells 66 on transfer surface 62. FIG. 3A shows a first pass between inkjet head 52 and transfer surface 62. The spacing of adjacent ink droplets 58 deposited onto transfer surface 62 during the first pass of FIG. 3A is substantially similar to the spacing of inkjet nozzles 56 on inkjet head 52.

In a second pass (shown in FIG. 3B), inkjet head (now referenced 52') and transfer surface 62 are moved laterally (in one of the directions of arrow 68) with respect to each other. Nozzles (now referenced 56') expel ink droplets 58', which register themselves in cells 66 on transfer surface 62. The spacing of adjacent ink droplets 58' deposited onto transfer surface 62 during the second pass of FIG. 3B is substantially similar to the spacing of inkjet nozzles 56' on inkjet head 52'. In a third pass (shown in FIG. 3C), inkjet head (now referenced 52") and transfer surface 62 are again moved laterally with respect to each other. Nozzles (now referenced 56") expel ink droplets 58", which register themselves in cells 66 on transfer surface 62. The spacing of adjacent ink droplets 58" deposited onto transfer surface 62 during the third pass of FIG. 3C is substantially similar to the spacing of inkjet nozzles 56" on inkjet head 52".

As can be seen in FIG. 3C, after three interleaved passes, fluid ink droplets 58, 58' and 58" are deposited with an inter-channel spacing that is ⅓ that of inkjet nozzles 56. Those skilled in the art will appreciate that interleaved deposition of ink droplets 58 onto transfer surface 62 may be used in this manner to achieve higher resolution images.

In the illustrated embodiment of FIGS. 3A–3C, inkjet head 52 moves laterally (in one of the directions of arrow 68) relative to transfer surface 62. It will be appreciated by those skilled in the art, that the same interleaving process may be effected by moving transfer surface 62 laterally relative to inkjet head 52. The illustrated embodiment shows an interleaving technique comprising three passes between inkjet head 52 and transfer surface 62. It will also be appreciated by those skilled in the art that interleaving may be accomplished with a greater or fewer number of passes.

Referring back to FIG. 2, ink droplets 58 deposited onto transfer surface 62, register themselves in cells 66 of transfer surface 62. A substrate 70 is then translated in either or both of the scan directions indicated by arrow 74 so as to roll between drum 64 and an elastomeric roller 72. Elastomeric roller 72 and drum 64 work together to bring ink droplets 58 on transfer surface 62 into contact with substrate 70. Ink droplets 58 are transferred onto substrate 70 in their desired locations to form an image 80 on substrate 70. FIG. 2 depicts only one pass between transfer surface 62 and substrate 70. Fluid ink droplets 58 are transferred from transfer surface 62 to substrate 70 to form a plurality of channels 76 on substrate 70. In the illustrated embodiment, inkjet head 52 is narrower than transfer surface 62 and ink droplets 58 are transferred to substrate 70 prior to imparting the complete image 80 onto transfer surface 62. Consequently, in the illustrated embodiment, multiple passes and lateral stepping between transfer surface 62 and substrate 70 are required to completely transfer image 80 to substrate 70. In other embodiments, not shown, the full width of image 80 may be deposited on transfer surface 62, such that image 80 may be completely transferred to substrate 70 in a single pass. In the illustrated embodiment, ink droplets 58 are deposited onto adjacent cells 66 on transfer surface 62. As a result, the spacing 78 of channels 76 transferred onto substrate 70 during a single pass between transfer surface 62 and substrate 70 corresponds with the spatial period of cells 66 on transfer surface 62.

As with the expulsion of ink droplets 58 from nozzles 56 of inkjet head 52, ink droplets 58 may be transferred from transfer surface 62 to substrate 70 in a single pass or in multiple passes. Multiple passes between transfer surface 62 and substrate 70 may be used to apply a different color of ink droplets 58 in each pass. For example, red ink droplets 58 may be image-wise applied to selected locations on transfer surface 62 and then transferred to substrate 70 in a first pass, blue ink droplets 58 may be image-wise applied to selected locations on transfer surface 62 and then transferred to substrate 70 in a second pass and green ink droplets 58 may be applied to selected locations on transfer surface 62 and then transferred to substrate 70 in a third pass. In an alternative example, printing apparatus 50 may use a CMYK process, where cyan ink droplets 58 may be image-wise applied to selected locations on transfer surface 62 and then transferred to substrate 70 in a first pass, magenta ink droplets 58 may be image-wise applied to selected locations on transfer surface 62 and then transferred to substrate 70 in a second pass, yellow ink droplets 58 may be applied to selected locations on transfer surface 62 and then transferred to substrate 70 in a third pass and black ink droplets 58 may be applied to selected locations on transfer surface 62 and then transferred to substrate 70 in a fourth pass. Multiple colors of ink droplets 58 may also be transferred from transfer surface 62 to substrate 70 in a single pass.

Alternatively or additionally, where image resolution finer than the spatial period 84 of cells 66 of transfer surface 62 is required, multiple passes between transfer surface 62 and substrate 70 may be used to effect an interleaved transfer of fluid ink droplets 58 onto substrate 70. A particular example of interleaved transfer of fluid ink droplets 58 onto substrate 70 is shown in FIGS. 4A through 4D. FIGS. 4A through 4D are exploded sectional views of transfer surface 62 transferring ink droplets 58 from its cells 66 onto substrate 70. In a first pass shown in FIG. 4A, transfer surface 62 is in a first position with respect to substrate 70 and fluid ink droplets 58, which are registered to cells 66, are transferred from transfer surface 62 to substrate 70.

Figure 4A:
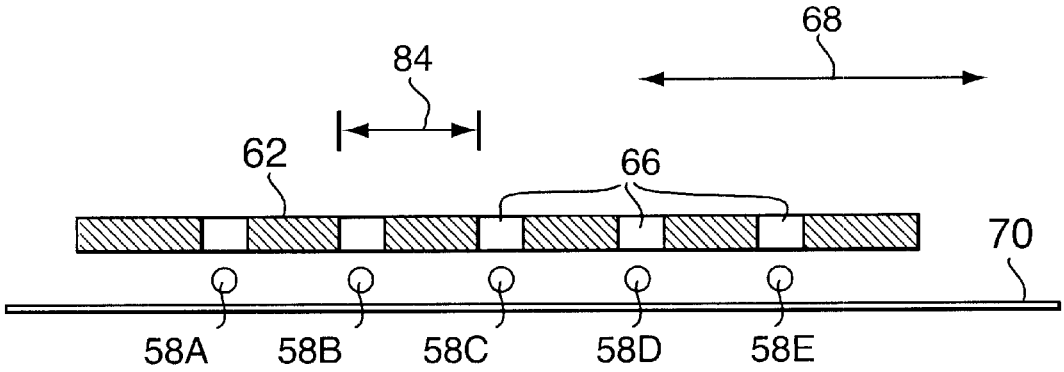
FIGS. 4A to 4D depict a particular embodiment of a method for interleaving between the transfer surface and the substrate according to the invention.
Figure 4B:
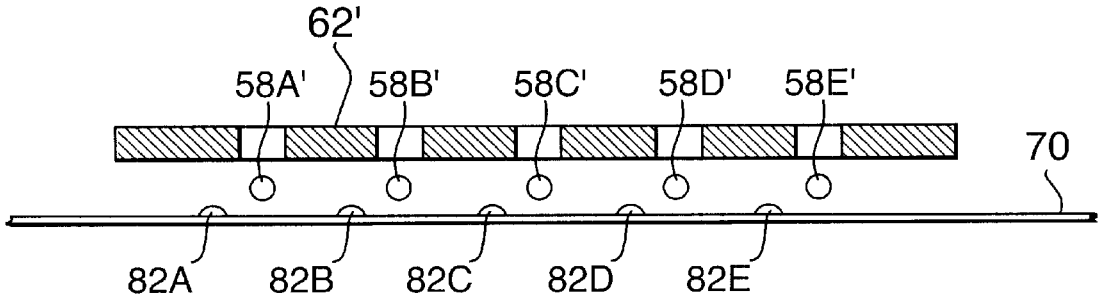
Figure 4C:
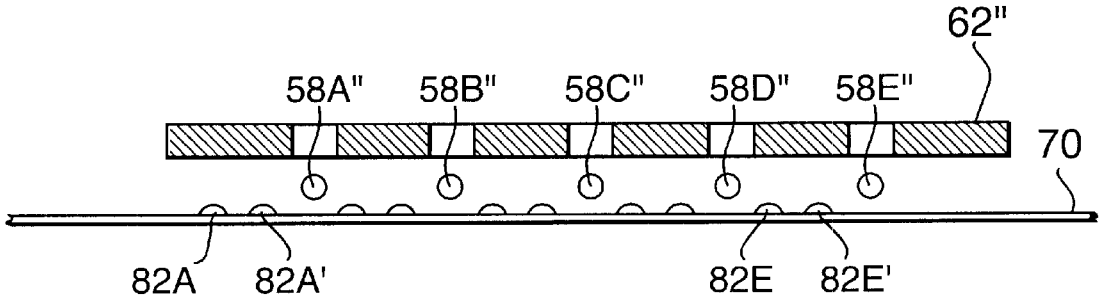

FIG. 4B depicts a second pass where the transfer surface (now referenced 62') has moved laterally (in one of the directions of arrow 68) relative to substrate 70. Fluid ink droplets (now referenced 58'), which are registered to cells 66, are transferred from transfer surface 62' to substrate 70. In the illustrated embodiment, the ink droplets 58 deposited in the first pass of FIG. 4A wet substrate 70 to become printed dots 82. It can be seen from FIG. 4B that the spacing of printed dots 82 deposited onto substrate 70 during the first pass of FIG. 4A is substantially similar to the spatial period 84 of cells 66 on transfer surface 62. FIG. 4C depicts a third pass, where the transfer surface (now referenced 62") has again moved laterally relative to substrate 70. Fluid ink droplets (now referenced 58"), which are registered to cells 66, are transferred from transfer surface 62 to substrate 70. Ink droplets 58' deposited in the second pass of FIG. 4B also wet substrate 70 to become printed dots 82'. Finally, in FIG. 4D, all of ink droplets 58" from the third pass of FIG. 4C wet substrate 70 to form printed dots 82".

Figure 4D:
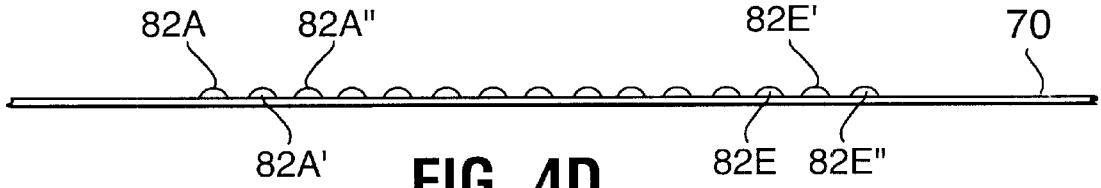

As can be seen in FIG. 4D, after three interleaved passes, printed dots 82, 82' and 82" are transferred with a spacing that is ⅓ that of spatial period 84 of cells 66. Those skilled in the art will appreciate that interleaved transfer of ink droplets 58 from transfer surface 62 onto substrate 70 may be used in this manner to achieve higher resolution images.

In the illustrated embodiment of FIGS. 4A–4D, transfer surface 62 moves laterally (in one of the directions of arrow 68) relative to substrate 70. It will be appreciated by those skilled in the art, that the same interleaving process may be effected by moving substrate 70 laterally relative to transfer surface 62. The illustrated embodiment shows an interleaving technique comprising three passes between transfer surface 62 and substrate 70. It will also be appreciated by those skilled in the art that interleaving may be accomplished with a greater or fewer number of passes.

In general, a fluid ink droplet 58 expelled from nozzle 56 of an inkjet head 52 onto a surface (i.e. such as transfer surface 62 or substrate 70) will deform when it hits the surface and will eventually come to rest on the surface. Ink droplet 58 will assume a shape on the surface. Typically, this shape will be quasi-spherical in nature and the distortion away from a perfect spherical shape will be determined by factors including the surface energy of the surface material (s) and the surface tension of ink droplet 58. The precise shape that ink droplet 58 will assume on transfer surface 62 depends on the particular combination of liquid ink and surface materials.

Typically, ink may be water-based or oil-based. A surface that repels water-based ink is said to be hydrophobic and a surface that attracts water-based ink is said to be hydrophilic. Similarly, a surface that repels oil-based ink is said to be oleophobic and a surface that attracts oil-based ink is said to be oleophilic. A single monolayer of material may change the behavior of a surface between hydrophilic and hydrophobic or between oleophilic and oleophobic.

A water-based ink droplet 58 on a hydrophilic surface tends to distort away from a spherical shape. The surface energy of a hydrophilic surface material is greater than the surface tension of the ink. With such a combination of ink and surface material, ink droplet 58 exhibits a degree of adhesion to the surface material and is said to "wet" the surface material.

This type of ink and material combination is not well suited for a transfer surface (i.e. such as transfer surface 62 of FIG. 2), because any ink that wets the transfer surface is difficult to transfer from the transfer surface to the desired printing surface (i.e. substrate 70 of FIG. 2). Water-based ink droplets 58 will tend to stick to a hydrophilic transfer surface 62, decreasing the transfer efficiency (i.e. the percentage of ink droplet 58 that is transferred to substrate 70) and causing corresponding difficulties associated with cleaning leftover ink from transfer surface 62 and spreading of leftover ink into other system components. Oil-based ink droplets on oleophilic surfaces exhibit similar properties. Consequently, if oil-based ink is used, oleophilic surface material is not a good choice for transfer surface 62, because of low transfer efficiency (i.e. the percentage of ink droplet 58 that is transferred to substrate 70) and corresponding difficulties associated with cleaning leftover ink from transfer surface 62 and spreading of leftover ink into other system components.

In contrast, if a surface is hydrophobic, then a water-based ink droplet 58 tends to maintain a more nearly spherical shape. The surface energy of a hydrophobic material is less than the surface tension of the water-based ink. With such a combination of surface material and ink, ink droplets 58 do not adhere well to the surface. Such non-adhering ink droplets 58 may be easily transferred from a transfer surface (i.e. transfer surface 62 of FIG. 2) to a final printing surface (i.e. substrate 70 of FIG. 2). A potentially undesirable consequence of having ink droplets 58 that do not adhere to a surface is that immediately adjacent ink droplets 58 may tend to coalesce with one another. Oil-based ink droplets on oleophobic surfaces exhibit similar properties.

Figure 5A:
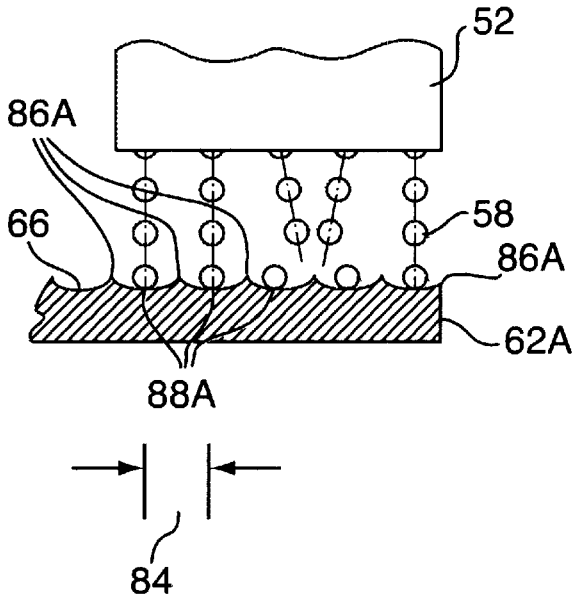
FIG. 5A is a sectional view of a transfer surface according to a first embodiment of the invention.

FIG. 5A depicts a sectional view of a transfer surface 62A according to a first embodiment of the invention. Transfer surface 62A is constructed to improve printing accuracy, overcome ink droplets 58 that are inconsistently expelled from nozzles 56, prevent coalescing of adjacent ink droplets 58 and maximize transfer efficiency from transfer surface 62A to substrate 70, by providing a structure which is not wetted by ink droplets 58 and which causes ink droplets 58 to register themselves at desired locations. Transfer surface 62A comprises a hydrophobic material, such as TEFLON™ or silicone. Alternatively or in addition, transfer surface 62A may be treated with a coating layer of hydrophobic material, such as silicone or a suitable flourocarbon to achieve its hydrophobic state. Transfer surface 62A is patterned with a periodic array of cells 66, each of which comprises a depression 88A surrounded by elevated ridges 86A.

Cells 66 of transfer surface 62 may be periodic in two dimensions as shown in FIG. 2 (for example, the lateral directions indicated by arrow 68 and the orthogonal scan direction indicated by arrow 74). In some embodiments, the spatial period 84 of cells 66 may be the same as the spacing of nozzles 56 in inkjet head 52. In some embodiments (not shown), the periodic array of cells 66 may be periodic in only one dimension (for example, the lateral directions indicated by arrow 66 of FIG. 2). In still other embodiments (not shown), cells 66 may be assembled into groups of cells, each group comprising a plurality of cells. Preferably, a group of cells may comprise three or more cells, where each cell in a group may be used to hold a different color of ink droplet. These groups of cells may be periodic in one or more dimensions.

In a particular embodiment, shown in FIG. 5A, cells 66 are separated by ridge areas 86A. Ridge areas 86A may be approximately 1/2400 of an inch (10 microns) in width and up to 1/4800 of an inch (5 microns) in height. In other embodiments, ridge areas 86A may be greater than 5 microns in height or substantially less than 5 microns in height.

An example of a commercial product upon which the texturing depicted in FIG. 5A may be created is a printing plate known as PEARLdry™ and manufactured by Presstek, Inc., New Hampshire. Such printing plates can be written with any desired pattern and applied to the cylindrical surface of drum 64 prior to or after being imaged.

Suitable transfer surfaces 62A may also be produced by chemical vapor deposition (CVD) or plasma vapor deposition (PVD) of hydrophobic materials on the substrate of the transfer member.

In operation, one ink droplet 58 may be image-wise expelled by inkjet head 52 into any or each of cells 66. The choice (made by the controller) as to whether an ink droplet 58 is expelled into a particular cell 66 is determined by whether ink is required at a corresponding location of substrate 70 to form image 80. The periodic array of cells 66 provides a grid of minimum energy regions based on a varying combination of surface energy and surface tension across a cell 66. In the embodiment of FIG. 5A, it is predominantly the surface tension of water-based ink droplets 58 that ensures that droplets 58 locate themselves at or near the centers of depressed regions 88A of cells 66. The grid of minimum energy regions 88A on transfer surface 62A helps to correct the positions of any ink droplets 58 that may be out of position due to inconsistent expulsion trajectories from nozzles 56 of inkjet head 52. The grid of minimum energy regions 88A on transfer surface 62A also prevents individual ink droplets 58 from coalescing with one another on transfer surface 62A by tending to make ink droplets 58 register themselves at the desired locations. The hydrophobic nature of transfer surface 62A facilitates transfer of ink droplets 58 transfer to the surface of substrate 70.

Figure 5B:
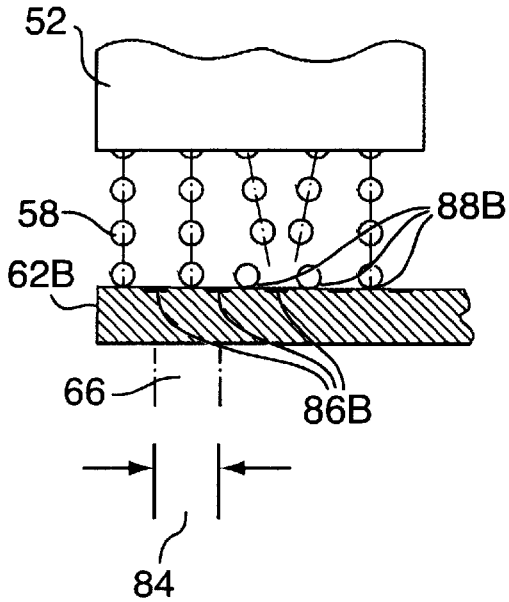
FIG. 5B is a sectional view of a transfer surface according to a second embodiment of the invention.

FIG. 5B depicts a cross-sectional view of a transfer surface 62B according to another embodiment of the invention. Transfer surface 62B is a smooth surface, which comprises a less strongly hydrophobic material, which could be, for example, a metal (e.g. anodized aluminum), glass, ceramic or polymer. A more highly hydrophobic material, such as silicone or fluorocarbon is then applied to surface 62B in regions 86B to form a periodic array of cells 66, which comprise semi-hydrophobic regions 88B surrounded by highly hydrophobic regions 86B. Alternatively or additionally, transfer surface 62B of FIG. 5B may be fabricated using a highly hydrophobic material as a base material and then applying regions 88B of a less strongly hydrophobic material to the surface to form cells 66.

As with the embodiment of FIG. 5A, the regular pattern of cells 66 on transfer surface 62B may be periodic in two dimensions as illustrated in FIG. 2 (for example, the lateral directions indicated by arrows 68 and the orthogonal scan direction indicated by arrow 74). In other embodiments (not shown), cells 66 may be periodic in a single dimension (for example, the lateral directions indicated by arrow 68 of FIG. 2). In still other embodiments (not shown), cells 66 may be grouped into groups of cells, each group comprising a plurality of cells. Preferably, a group of cells may comprise three or more cells, where each cell in a group may be used to hold a different color of ink droplet. The groups of cells may be periodic in one or more dimensions.

As with the embodiment of FIG. 5A, ink droplets 58 may be image-wise expelled by inkjet head 52 into each or any of cells 66. The choice (made by a controller) as to whether an inkjet droplet 58 is expelled into a particular cell 66 is determined by whether ink is required at a corresponding location on substrate 70 to form image 80. The periodic array of cells 66 formed by semi-hydrophobic regions 88B and highly hydrophobic regions 86B forms a regular pattern having minimum energy regions at or near the centers of semi-hydrophobic regions 88B. Water-based ink droplets 58 tend to move away from highly hydrophobic regions 86B and towards semi-hydrophobic regions 88B. The regular pattern of minimum energy regions 88B on transfer surface 62B helps to correct the positions of any ink droplets 58 that may be out of position due to inconsistent expulsion trajectories from nozzles 56 of inkjet head 52. The regular pattern of minimum energy regions 88B on transfer surface 62B also prevents the coalescing of adjacent ink droplets 58 on transfer surface 62B by tending to make ink droplets 58 register themselves at the desired locations. The hydrophobic nature of the transfer surface 62B facilitates transfer of ink droplets 58 to the surface of substrate 70.

In a third embodiment (not depicted) a transfer surface comprising a combination of the previous two embodiments may be employed. Such a combination involves a hydrophobic transfer surface that is shaped in a manner similar to that of FIG. 5A with a plurality of cells formed with ridges and depressed regions (see ridges 86A and depressed regions 88A of FIG. 5A). The depressed regions of the transfer surface may be made less strongly hydrophobic than the adjacent ridge areas. In such a combination embodiment, surface tension of the water-based ink droplets 58 combined with surface energy created by the ridges and depressed regions act together to cause ink droplets 58 to locate themselves in the depressed regions near the center of the cells on the transfer surface.

In some embodiments, it can be advantageous to treat or modify ink droplets 58 on transfer surface 62 prior to transferring them to substrate 70. In particular, the size and rheological properties of ink droplets 58 may be changed by various forms of post-expulsion processing, including, without limitation: electromagnetic irradiation, vacuum treatment, gaseous flow, chemical treatment and heat treatment which may be performed by microwave heating, radiative heating and/or conduction heating.

In particular, while ink droplets 58 are on transfer surface 62, it may be advantageous to cure or partially cure ink droplets 58, to increase the viscosity of ink droplets 58, to change the water solubility of ink droplets 58, to change the surface energy of ink droplets 58, to evaporate some or all of the solvent contained in ink droplets 58 or to reduce the size of ink droplets 58. Particular methods and apparatus for treatment of ink droplets 58 on a transfer surface are discussed in a co-owned U.S. Patent Application, entitled "Method for Imaging with UV Curable Inks", filed May 24, 2002 (serial no. as yet unassigned), which names as inventors Daniel Gelbart and Murray Figov and which is hereby incorporated by reference.

Once ink droplets 58 are transferred from transfer surface 62 to substrate 70, ink droplets 58 may be cured. Curing may comprise processes, such as: irradiation (i.e. with electromagnetic radiation, which may include visible light, ultraviolet radiation and/or infrared radiation), vacuum treatment, gaseous flow (i.e. air flow and/or flow of another gas, such as $N_2$), chemical treatment, heat treatment or a combination of these techniques. Heat treatment may comprise microwave heating, radiative heating and/or conduction heating.

As will be apparent to those skilled in the art in the light of the foregoing disclosure, many alterations and modifications are possible in the practice of this invention without departing from the spirit or scope thereof. For example:

Redundancy may be built into the invention by having more than one nozzle 56 in inkjet head 52 be addressed to deposit ink into a particular cell 66 of transfer surface 62. Redundancy may be used in situations where inkjet nozzles 56 are blocked or otherwise fail to perform as expected.

The relationship between the spacing of inkjet nozzles 56 and the cellular period 84 on transfer surface 62 need not be one to one. These parameters may be integer multiples of one another. In the case where the nozzle spacing is a multiple of the cellular period, inkjet head 52 may be translated laterally (i.e. in the directions of arrow 68 of FIG. 2) and may make multiple passes over transfer surface 62 to ensure that ink droplets 58 are deposited into each desired cell 66, thereby ensuring that the final image has at least the full resolution of transfer surface 62. Where the resolution of inkjet nozzles is finer than the spatial period 84 of cells 66 on transfer surface 62, ink droplets 58 may be deposited only in the locations of cells 66 and redundancy techniques may be incorporated.

The above discussion of the embodiments of FIGS. 5A and 5B and the embodiment combining FIGS. 5A and 5B involved water-based ink and a generally hydrophobic transfer surface 62. The same principle of operation may be applied using oil-based ink and oleophobic materials. For example, a silicone-coated transfer surface 62, which is oleophobic, will repel droplets 58 of oil-based ink. If such a silicone-coated surface is patterned with a periodic pattern of ridges 86A and depressed regions 88A (see FIG. 5A), oil-based ink droplets 58 will register to the pattern. In a second example, a transfer surface similar to transfer surface 62B of FIG. 5B may be constructed using highly-oleophobic materials in regions 86B and less strongly oleophobic materials in regions 88B. Oil-based ink droplets 58 will register to such a pattern. The embodiments of FIGS. 5A and 5B may be combined to form cells 66 defined by a periodic pattern of ridges and depressed regions where the ridges are formed with highly-oleophobic materials and the depressed regions are formed with less strongly oleophobic materials. These techniques are important when ultra-violet-cured inks are used, as many ultra-violet types of ink are not water-based.

Figure 6:
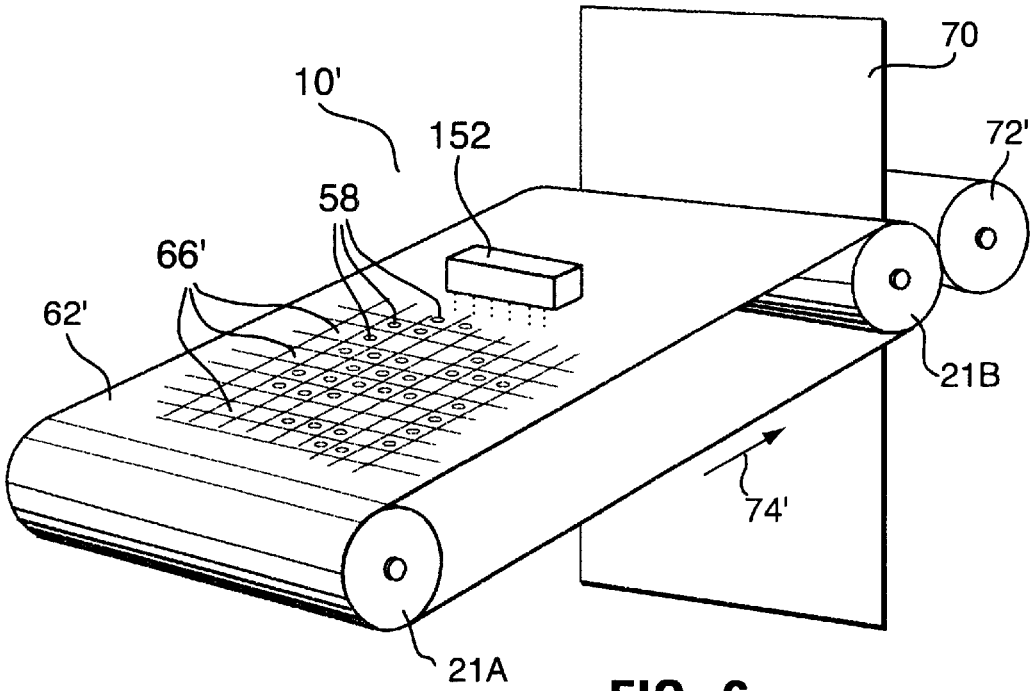
FIG. 6 is an isometric view of a method and apparatus for inkjet printing on a substrate according to another embodiment of the invention.

FIG. 6 depicts an alternative embodiment of an apparatus 10' according to the invention. In the embodiment of FIG. 6, transfer surface 62' is shaped in a conveyor belt-like configuration that is entrained over two cylinders 21A and 21B. A controller (not shown) causes inkjet head 152 to eject ink droplets 58 into each or any of cells 66' on transfer surface 62' in a manner similar to that of the embodiment of FIG. 2. Cells 66' have properties similar to those discussed above, which cause ink droplets 58 to register themselves to the low energy regions of individual cells 66'. For the sake of clarity, only a small number of cells 66' are shown on transfer surface 62' of FIG. 6. Transfer surface 62' is caused to move in the scan direction 24'. Substrate 70 is positioned between transfer surface 62' and roller 72'. As transfer surface 62' moves relative to substrate 70, ink droplets 58 are transferred to the surface of substrate 70.

The drum embodiment of FIG. 2 and the conveyor belt-like embodiment of FIG. 6 are not the only embodiments for a transfer surface. Other embodiments for a transfer surface may also be envisaged, where the transfer surface is flat in shape and the ink is transferred from the transfer surface to the substrate by bringing the substrate and the transfer surface together. In general, the invention should be considered to be independent of the macroscopic shape of the transfer surface and the manner in which the ink droplets are transferred from the transfer surface to the substrate.

The invention may be applied to printing on any suitable substrate materials, such as paper based materials, plastics, polymers, glass, metals, ceramics, silicon and printing plates.

Inkjet head 52 may comprise a number of separate inkjet heads which each eject droplets of different ink onto a transfer surface 62. The separate inkjet heads may be spaced-apart. Droplets expelled by one of the separate inkjet heads may be subjected to post expulsion processing, as described above, before a next set of droplets is applied by a next one of the separate inkjet heads. The post-expulsion processing may shrink the ink droplets on the transfer surface.

Figure 7:
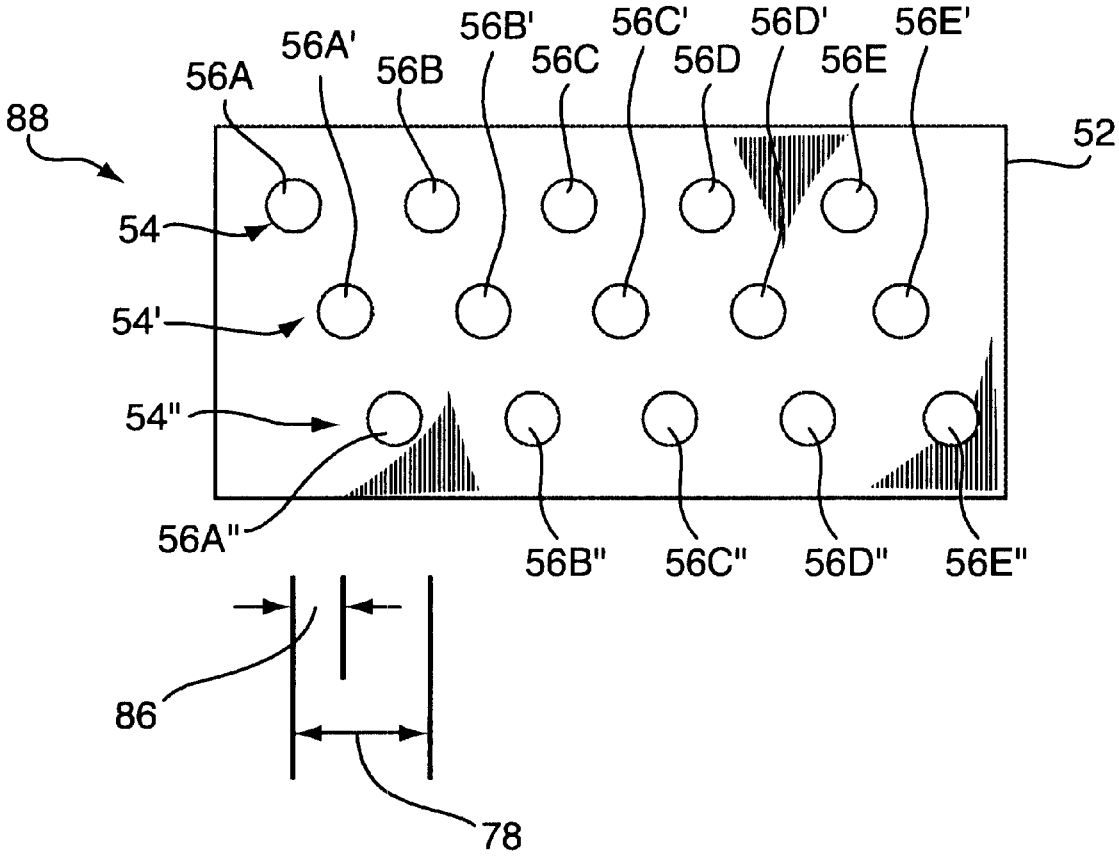
FIG. 7 is a bottom plan view of an inkjet head comprising a two-dimensional array of nozzles.

Inkjet head 52 may also comprise two-dimensional arrays 88 of nozzles 56 comprising a plurality of one-dimensional arrays 54, 54', 54" as shown in FIG. 7. One-dimensional arrays 54, 54', 54" of nozzles 56 may be offset from one another (i.e. interlaced) as shown in FIG. 7. Interlacing arrays 54, 54', 54" in the manner shown in FIG. 7 creates a small inter-channel separation 86 to achieve relatively high resolution expulsion in a single pass between inkjet head 52 and transfer surface 62, while maintaining a sufficient spacing 78 between adjacent nozzles 56 to avoid "cross-talk" between nozzles 56. Inkjet heads 52 incorporating two-dimensional arrays 88 of nozzles 56 may still employ any of the interleaving techniques discussed above.

Accordingly, the scope of the invention is to be construed in accordance with the substance defined by the following claims.

What is claimed is:

1. A method for the image-wise transfer of water-based fluid droplets from at least one fluid droplet source onto a substrate, the method comprising:

ejecting fluid droplets from the at least one fluid droplet source onto a hydrophobic transfer surface which comprises a spatially periodic arrangement of less-strongly hydrophobic regions and more-strongly hydrophobic regions which are more strongly hydrophobic than the less strongly hydrophobic regions;

adjusting a spatial registration of the fluid droplets on the transfer surface; and transferring the fluid droplets from the transfer surface to the substrate by bringing the fluid droplets on the transfer surface into contact with the substrate.

2. A method according to claim 1, wherein adjusting a spatial registration of the fluid droplets on the transfer surface comprises permitting the fluid droplets to interact with the hydrophobic transfer surface and at least one of the plurality of less hydrophobic regions.

3. A method according to claim 1, wherein the at least one fluid droplet source comprises a plurality of fluid droplet sources spaced apart from one another by a separation and wherein there is an integer relationship between a period of the less hydrophobic regions and the separation of the fluid droplet sources.

4. A method according to claim 1 comprising modifying one or more rheological characteristics of the fluid droplets while the fluid droplets are on the transfer surface.

5. A method according to claim 4, wherein modifying one or more rheological characteristics of the fluid droplets comprises at least one of: curing the fluid droplets, partially curing the fluid droplets, increasing a viscosity of the fluid droplets, changing a solubility of the fluid droplets, changing a surface energy of the fluid droplets and evaporating a solvent contained in the fluid droplets.

6. A method according to claim 4, wherein modifying one or more rheological characteristics of the fluid droplets comprises at least one of: irradiating the fluid droplets with electromagnetic energy; subjecting the fluid droplets to vacuum treatment, subjecting the fluid droplets to gaseous flow treatment, subjecting the fluid droplets to chemical treatment and heating the fluid droplets.

7. A method according to claim 1 comprising modifying sizes of the fluid droplets while the fluid droplets are on the transfer surface.

8. A method according to claim 1, wherein the transfer surface is on a cylindrical surface of a drum.

9. A method according to claim 8, wherein bringing the fluid droplets on the transfer surface into contact with the substrate comprises rolling the substrate against the drum.

10. A method according to claim 1, wherein the transfer surface comprises a belt member and the method comprises circulating the belt member while ejecting fluid droplets onto the transfer surface.

11. A method according to claim 1, wherein the less hydrophobic regions are periodic in one dimension.

12. A method according to claim 11, wherein the less hydrophobic regions are periodic in two dimensions.

13. A method according to claim 1, wherein the less hydrophobic regions comprise depressions in the hydrophobic transfer surface.

14. A method according to claim 1, wherein the one or more fluid droplet sources comprise an ink jet printer head.

15. A method according to claim 14, wherein ejecting fluid droplets from the one or more fluid sources onto a hydrophobic transfer surface comprises making multiple passes between the inkjet head and the transfer surface and, in each such pass, depositing a plurality of fluid droplets onto the transfer surface.

16. A method according to claim 15, wherein the plurality of fluid droplets deposited on each pass comprises fluid droplets of a different color.

17. A method according to claim 15, wherein the pluralities of fluid droplets deposited during successive passes are spatially interleaved with one another.

18. A method according to claim 1, wherein transferring the fluid droplets from the transfer surface to the substrate comprises making multiple passes between the transfer surface and the substrate and, in each such pass, transferring a plurality of fluid droplets onto the substrate.

19. A method according to claim 18, wherein the plurality of fluid droplets transferred on each pass comprises fluid droplets of a different color.

20. A method according to claim 18, wherein the pluralities of fluid droplets transferred during successive passes are spatially interleaved with one another.

21. A method according to claim 1 comprising curing the fluid droplets on the substrate.

22. A method according to claim 21, wherein curing the fluid droplets comprises one or more of: irradiating the fluid droplets with electromagnetic energy; subjecting the fluid droplets to vacuum treatment, subjecting the fluid droplets to gaseous flow treatment, subjecting the fluid droplets to chemical treatment and heating the fluid droplets.

23. A method according to claim 1, wherein ejecting the fluid droplets from the at least one fluid droplet source onto a hydrophobic transfer surface comprises ejecting fluid droplets of different colors onto the hydrophobic transfer surface.

24. A method according to claim 23, wherein transferring the fluid droplets from the transfer surface to the substrate comprises simultaneously transferring fluid droplets of different colors onto the substrate.

25. A method for the image-wise transfer of oil-based fluid droplets from at least one fluid droplet source onto a substrate, the method comprising:

ejecting fluid droplets from the at least one fluid droplet source onto an oleophobic transfer surface which comprises a spatially periodic arrangement of less-strongly oleophobic regions and more strongly oleophobic regions that are more strongly oleophobic than the less strongly oleophobic regions;

adjusting a spatial registration of the fluid droplets on the transfer surface; and, transferring the fluid droplets from the transfer surface to the substrate by bringing the fluid droplets on the transfer surface into contact with the substrate.

26. A method according to claim 25, wherein adjusting a spatial registration of the fluid droplets on the transfer surface comprises permitting the fluid droplets to interact with the oleophobic transfer surface and at least one of the plurality of less oleophobic regions.

27. A method according to claim 25, wherein the at least one fluid droplet source comprises a plurality of fluid droplet sources spaced apart from one another by a separation and wherein there is an integer relationship between a period of the less oleophobic regions and the separation of the fluid droplet sources.

28. A method according to claim 25 comprising modifying one or more rheological characteristics of the fluid droplets while the fluid droplets are on the transfer surface.

29. A method according to claim 28, wherein modifying one or more rheological characteristics of the fluid droplets comprises at least one of: curing the fluid droplets, partially curing the fluid droplets, increasing a viscosity of the fluid droplets, changing a solubility of the fluid droplets, changing a surface energy of the fluid droplets and evaporating a solvent contained in the fluid droplets.

30. A method according to claim 28, wherein modifying one or more rheological characteristics of the fluid droplets comprises at least one of: irradiating the fluid droplets with electromagnetic energy; subjecting the fluid droplets to vacuum treatment, subjecting the fluid droplets to gaseous flow treatment, subjecting the fluid droplets to chemical treatment and heating the fluid droplets.

31. A method according to claim 28, wherein the less oleophobic regions are periodic in one dimension.

32. A method according to claim 31, wherein the less oleophobic regions are periodic in two dimensions.

33. A method according to claim 25 comprising modifying sizes of the fluid droplets while the fluid droplets are on the transfer surface.

34. A method according to claim 25, wherein the less oleophobic regions comprise depressions in the oleophobic transfer surface.

35. A method according to claim 25, wherein the one or more fluid droplet sources comprise an ink jet printer head.

36. A method according to claim 35, wherein ejecting fluid droplets from the one or more fluid sources onto an oleophobic transfer surface comprises making multiple passes between the inkjet head and the transfer surface and, in each such pass, depositing a plurality of fluid droplets onto the transfer surface.

37. A method according to claim 36, wherein the plurality of fluid droplets deposited on each pass comprises fluid droplets of a different color.

38. A method according to claim 37, wherein the pluralities of fluid droplets transferred during successive passes are spatially interleaved with one another.

39. A method according to claim 36, wherein the pluralities of fluid droplets deposited during successive passes are spatially interleaved with one another.

40. A method according to claim 25, wherein transferring the fluid droplets from the transfer surface to the substrate comprises making multiple passes between the transfer surface and the substrate and, in each such pass, transferring a plurality of fluid droplets onto the substrate.

41. A method according to claim 40, wherein the plurality of fluid droplets transferred on each pass comprises fluid droplets of a different color.

42. A method according to claim 25 comprising curing the fluid droplets on the substrate.

43. A method according to claim 42, wherein curing the fluid droplets comprises one or more of: irradiating the fluid droplets with electromagnetic energy; subjecting the fluid droplets to vacuum treatment, subjecting the fluid droplets to gaseous flow treatment, subjecting the fluid droplets to chemical treatment and heating the fluid droplets.

44. A method according to claim 25, wherein ejecting the fluid droplets from the at least one fluid droplet source onto an oleophobic transfer surface comprises ejecting fluid droplets of different colors onto the oleophobic transfer surface.

45. A method according to claim 25, wherein transferring the fluid droplets from the transfer surface to the substrate comprises simultaneously transferring fluid droplets of different colors.

46. A method for the image-wise transfer of water-based fluid droplets from at least one fluid droplet source onto a substrate, the method comprising:

ejecting the fluid droplets from the at least one fluid droplet source onto a hydrophobic transfer surface which comprises a spatially periodic plurality of ridges and depressed regions; and transferring the fluid droplets from the transfer surface to the substrate by bringing the fluid droplets on the transfer surface into contact with the substrate.

47. A method for the image-wise transfer of oil-based fluid droplets from at least one fluid droplet source onto a substrate, the method comprising:

ejecting the fluid droplets from the at least one fluid droplet source onto a oleophobic transfer surface which comprises a spatially periodic plurality of ridges and depressed regions; and transferring the fluid droplets from the transfer surface to the substrate by bringing the fluid droplets on the transfer surface into contact with the substrate.

* * * * *